United States Patent [19]

Wanat

[11] 3,958,735

[45] May 25, 1976

[54] METHOD AND APPARATUS FOR DETECTING PAPER DRIVE MALFUNCTIONING IN AN AUTOMATIC PRINTER

[75] Inventor: Robert R. Wanat, Park Ridge, Ill.

[73] Assignee: Teletype Corporation, Skokie, Ill.

[22] Filed: Feb. 18, 1975

[21] Appl. No.: 550,382

[52] U.S. Cl. ..... 226/1; 226/11; 226/25; 226/43; 226/45

[51] Int. Cl.[2] ..... B65H 25/02

[58] Field of Search ..... 226/1, 2, 11, 25, 28, 226/33, 43, 45; 200/153 L, 153 LB, 61.13

[56] References Cited

UNITED STATES PATENTS

| | | | |
|---|---|---|---|
| 1,988,980 | 1/1935 | Debrie | 226/25 X |
| 3,071,332 | 1/1963 | Dain | 226/11 |
| 3,077,966 | 2/1963 | Cohn | 226/11 X |
| 3,659,081 | 4/1972 | Piccione | 226/25 X |
| 3,862,385 | 1/1975 | Johnson | 200/153 LB X |

*Primary Examiner*—Richard A. Schacher
*Attorney, Agent, or Firm*—W. K. Serp; J. L. Landis

[57] ABSTRACT

A drive shaft of an automatic printer engages tractors which, in turn, pull a paper web across a print mechanism. Located on the drive shaft is a drive shaft position cam which is fixed to the shaft and rotates therewith. Additionally, located upon the drive shaft for limited rotational movement thereon is a second cam. The shape of the second cam is similar to the shape of the first cam and formed integral with the second cam is a frictional surface engaged by the paper. During normal paper drive, the cams are out of registration and rotate in unison. In response to a paper jam condition, the first cam driven by the paper locks and the cams are forced into registration actuating a switch, the plunger of which rides on both of the cams. The switch signal thus serves to interrupt the paper drive mechanism in response to a paper jam condition.

17 Claims, 6 Drawing Figures

METHOD AND APPARATUS FOR DETECTING PAPER DRIVE MALFUNCTIONING IN AN AUTOMATIC PRINTER

BACKGROUND OF THE INVENTION

This invention generally relates to an apparatus for detecting a malfunction in the paper feed system of an automatic printer and more particularly relates to such a malfunction detection apparatus which includes means for sensing the presence of a paper jam within the printer and for sensing the depletion of the paper supply therein.

The rapid growth of data communications systems, over the last few years, has greatly increased the demand for high speed alphanumeric printers which type informational data in readable form upon a paper web. Such printers are frequently operated on a continuous basis and require operator attendance only for replacement of an exhausted paper supply or clearance of a paper jam. The paper stationary or forms used in such printers are generally supplied as a continuous sheet with transverse perforations facilitating the removal of selected pages. Additionally, extending longitudinally adjacent the margins of the paper are a series of spaced sprocket holes which are engaged by drive tractors provided on the printer, with the tractors driving the paper across the print mechanism.

A condition, which occasionally occurs during the operation of such printers, is that of a paper jam. On such an occasion, paper movement is inhibited; however, the drive tractors continue to move causing the paper perforations to be torn. Under such circumstances, the print mechanism generally continues to function producing "type-overs" which obliterate the previously typed information with subsequent print being rendered illegible. Occasionally, as a result of operator inattention, the paper supply of one of the printers under the operator's control may become exhausted resulting in a loss of information. Under such circumstances, damage to the ribbon may occur. Thus, it is particularly advantageous for such printers to include means for detecting the presence of a paper drive malfunction and for providing the attendant with a suitable indication as well as means for interrupting operation of the machine when such malfunction occurs.

The illustrated apparatus includes means for detecting the presence of a paper jam in a high speed sprocket printer and for interrupting the apparatus in the presence of such a condition as well as providing a suitable indication of such a paper jam condition. Further, means are included for detecting the condition of the paper supply and for interrupting the printer and providing a suitable indication to the operator when the paper supply is exhausted.

SUMMARY

Illustrated is an apparatus for sensing the operative condition of a continuous web transported along a predetermined path by a drive mechanism engaging the web. Means, driven by the web, are included for sensing movement of the web along the predetermined path. Additionally, means responsive to the web drive mechanism and to the web movement sensing means compare the actual movement of the web with the desired movement of the web as determined by the drive mechanism. The sensing means provides a signal which is related to the actual as compared to the desired web movement.

Additionally, the drive mechanism includes a first cam and the web movement sensing means includes a second cam. The second cam displays a shape which is similar to the shape displayed by the first cam. Means are included responsive to the relative positions of the cams which provide a signal in response to a predetermined relationship between the first and second cams.

Switch means are positioned for actuation by the web. The web, when present within the apparatus, maintains the switch in a first position and when absent actuates the switch to a second position thereby interrupting operation of the apparatus and providing the operator with a suitable indication.

It is a main object of this invention to provide an apparatus for controlling a web handling apparatus in response to a malfunction of the web movement. Other objects and advantages of the invention will be more readily appreciated after reference to the following description and accompanying drawings wherein:

DETAILED DESCRIPTION

General

Figure 1:
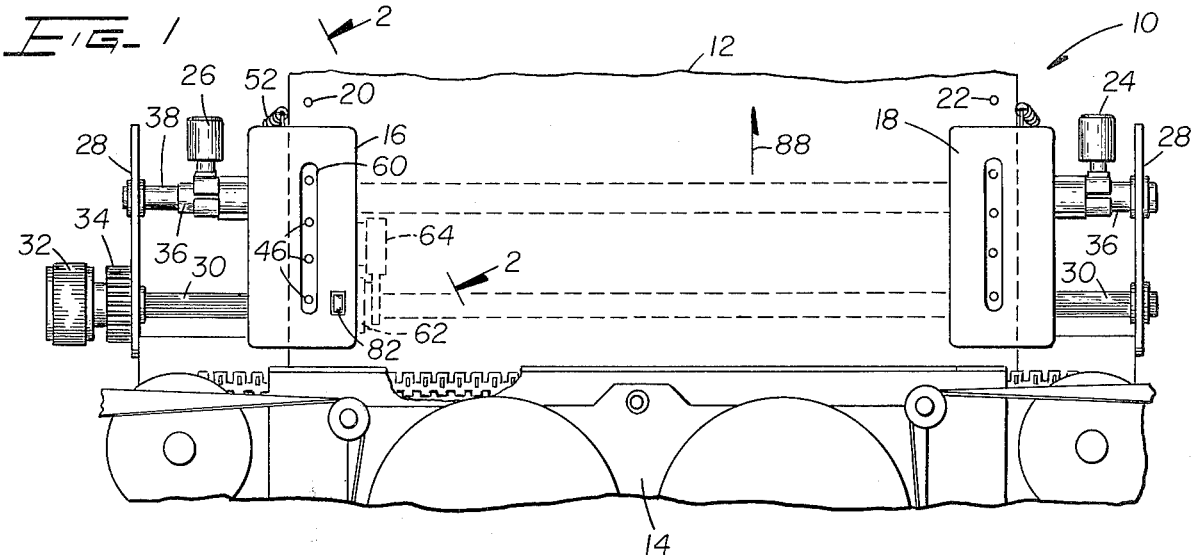
FIG. 1 is a front view of a portion of a printer including certain features of this invention.

With reference to FIG. 1, a portion of a high speed printer 10 for driving a continuous paper web 12 across a print mechanism 14 is illustrated. A suitable print mechanism for use with the illustrated apparatus is described in U.S. Pat. No. 3,822,641 entitled "Impactor Assembly for Printers" by Egon S. Babler issued July 9, 1974, having a common assignee with this application. The apparatus of FIG. 1 further includes a pair of drive tractors 16 and 18 which serve to drivingly engage sprocket holes 20 and 22 located along the longitudinal edges of the paper web 12 and thereby draw the paper across the print mechanism 14. Suitable drive tractors are described in U.S. Pat. No. 3,825,162 entitled "Feed Mechanism" issued to Leo J. Hubbard on July 23, 1974. Additionally, the illustrated apparatus includes form width adjustment means 24 for varying the relative spacing of the tractors 16 and 18 so as to permit adaptation to various web widths. Type margin adjustment means 26 are also included for positioning both tractors 16 and 18 in unison and thus the paper web 12 carried by the tractors with respect to the print mechanism 14 so as to effect accurate placement of the type margin upon the paper web 12. The illustrated adjustment means 24 and 26 are more fully described and illustrated in copending U.S. patent application, Ser. No. 534,025, filed Dec. 18, 1974, by R. R.

Wanat having a common assignee with this application.

More particularly, the printer 10 includes a main frame 28 which supports an elongated splined drive shaft 30, the longitudinal axis of which is parallel to the plane of the web 12. The shaft 30 drivingly passes through the tractors 16 and 18 and is manually driven by a knurled web advance knob 32 secured to one end thereof adjacent the main support frame. Additionally, the splined drive shaft 30 is automatically driven by a suitable motor 33 (schematically illustrated in FIG. 6) through gearing means 34. The drive tractors 16 and 18 slidably move along the drive shaft 30 and are also mounted upon a slide tube 36 which, in turn, slides upon a support rod 38. The axis of the rod 38 is parallel to the axis of the drive shaft 30. The ends of the support rod 38 are secured to the main support frame 28 with the axis of the rod 38 substantially parallel to the plane of the paper web 12. The rod 38, in conjunction with the splined drive shaft 30, provides a railed path upon which the tractors 16 and 18 ride.

Adjustment of the spacing of the tractors 16 and 18 accommodate a selected paper web 12 width is accomplished by loosening the clamp 24 and sliding the tractor 18 along the slide tube 36 until the desired tractor spacing is attained. Placement of the type margin on the paper 12 is effected by loosening the clamp 26 and sliding the tube 36 with respect to the rod 38. In this manner, the paper 12 is positioned with respect to the print mechanism 14 so as to locate the type margin at the desired location on the paper 12. This subject is considered in greater detail in the aforementioned copending U.S. patent application by R. R. Wanat.

Figure 2:
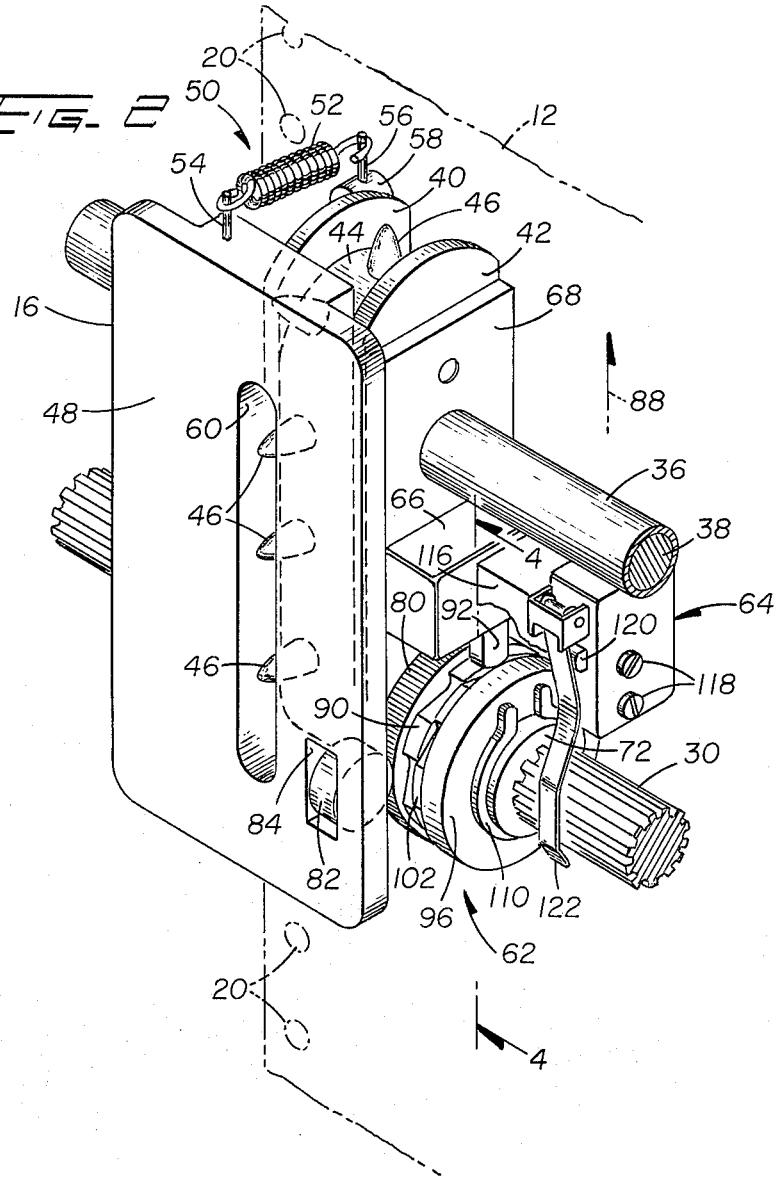
FIG. 2 is a prospective view of a portion of the apparatus of FIG. 1 taken substantially along the line 2—2 of FIG. 1.

With reference to FIG. 2, the tractor 16 includes a pair of parallel positioned end plates 40 and 42 through which the drive shaft 30, support rod 38, and slide tube 36 pass. Positioned between the end plates 40 and 42 and aligned thereby is a continuous flexible belt 44 carrying a plurality of equally spaced web pull pins 46. The pins 46 are spaced to engage the holes 20 defined along the margin of the paper web 12. The splined drive shaft 30 engages the belt 44 so that as the shaft 30 rotates, the paper web 12 engaged by the pull pins 46 is drawn across the print mechanism 14. Serving to hold the web 12 against the belt 44 and thus assure driving engagement by the pull pins 46 is a door 48 hinged to the support plate 40 and movable from a closed position to an open position. Maintaining the door securely in its selected position is an over center toggle mechanism 50 including a coil spring 52 one end of which is secured to a pin 54 affixed to the top of the door 48. The remaining end of the spring 52 is secured to a pin 56 extending from a pin support tab 58 formed on the tractor side plate 40. Additionally, the door defines an elongated opening 60 through which the pull pins 46 project, thus assuring that the web 12 will remain engaged by the pins 46. Secured to the side plate 42 of the tractor and positioned for engagement with the paper web 12 are paper jam 62 and paper supply 64 sensing means which will be hereinafter considered in greater detail.

Paper Jam Sensor

Figure 3:
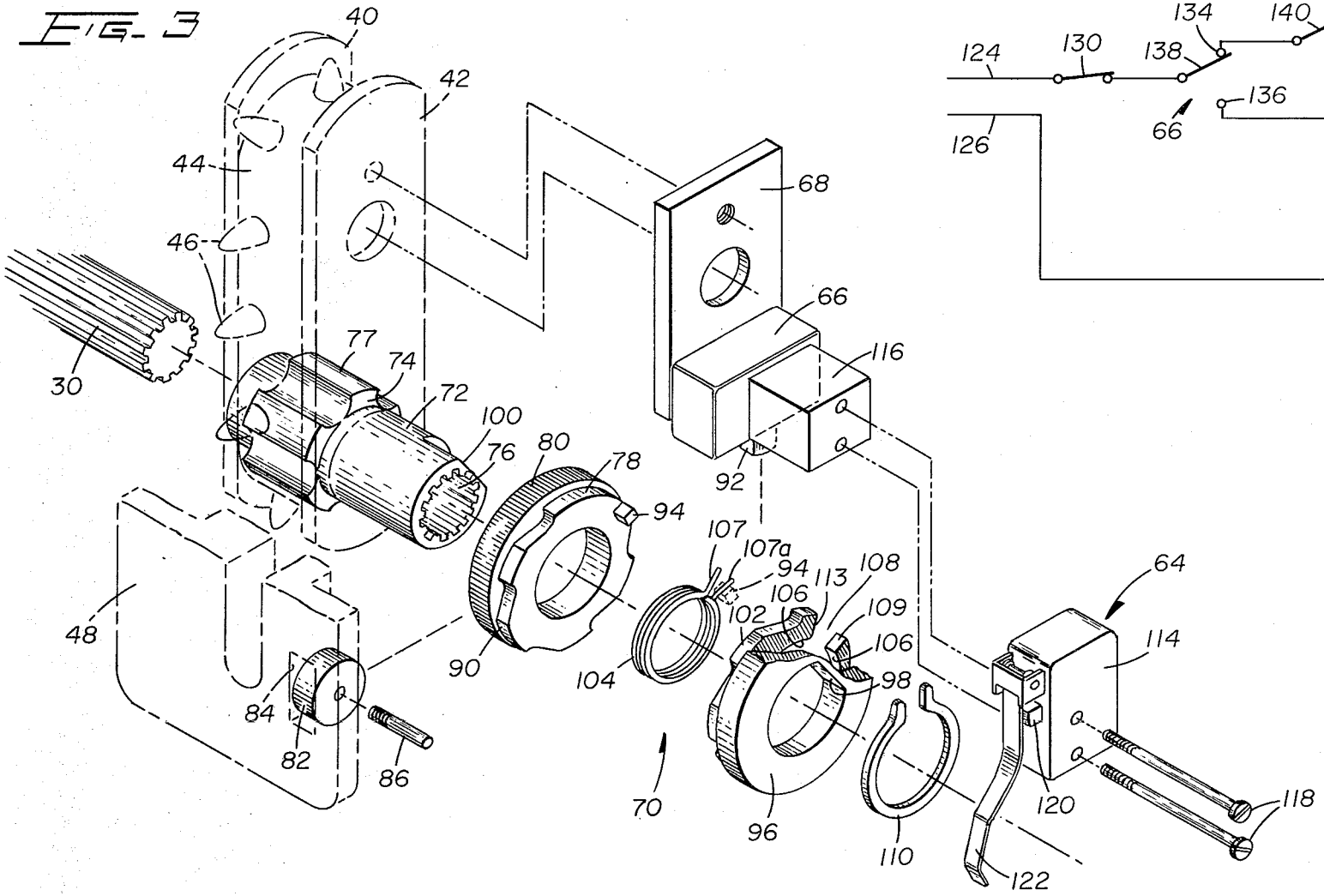
FIG. 3 is an exploded assembly view of a portion of the apparatus illustrated in FIG. 2.

With particular reference to FIG. 3, the paper jam sensor includes a plunger operated single pole double throw paper jam switch 66 secured to a mounting plate 68 carried on the side plate 42 of the drive tractor 16. Serving to actuate the switch in response to paper jam condition, is a switch actuating means 70 carried on a cylindrical extension 72 of a pull pin belt drive gear 74 forming a component part of the tractor 16. The tractor drive gear defines an opening 76 having fluted walls adapted to engage the splined drive shaft 30 so that as the drive shaft rotates, outwardly disposed teeth 77 of the drive gear engage the inner surface of the belt 44 which carries the tractor pull pins 46 thus drawing the paper 12 across the print mechanism 14.

Rotatably positioned upon the tractor drive shaft extension 72 for limited rotational movement thereabout is a paper advance cam 78. The cam 78 is directly driven by the paper web which engages a knurled paper engaging surface 80 of the cam as will be subsequently further considered. Positioned adjacent the knurled surface of the cam 78 is a paper pressure roller 82 which is rotatably supported on the lower end of the tractor door 48. The tractor door 48 defines an elongated slot 84 into which the pressure roller 82 is freely positioned and an axle pin 86 is passed through the door providing rotating support for the roller 82. As previously mentioned, the door 48 is biased into position by means of the coil spring 52 which also forces the roller 82, carried by the door, against the surface of the paper thereby forcing it into frictional drive engagement with the knurled surface 80 of the paper advance cam 78. Thus, as the paper moves through the printer in the direction indicated by the arrow 88 of FIG. 2, the cam 78 rotates in a clockwise direction as viewed in FIGS. 2 and 3. The diameter of the knurled cam surface 80 is determined in relation to the diameter of the tractor drive gear 74 and is designed to have a circumferential dimension slightly less than the circumference of the tractor drive gear. Thus, the speed of angular rotation of the cam 78 is slightly greater than that of the gear 74 for reasons to be subsequently considered. The paper advance cam 78 additionally displays a camming surface 90 upon which a plunger 92 of the switch 66 rides and further defines a cam spring tab 94 projecting from the face of the cam in a direction parallel to the axis of the drive shaft 30.

Figure 4:
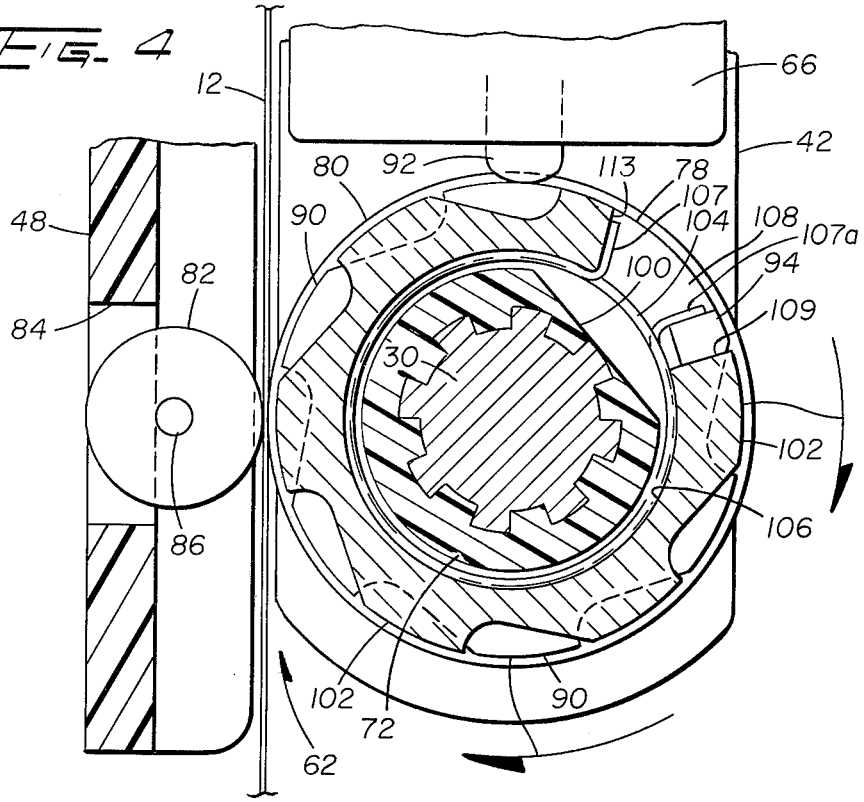
FIG. 4 is a partial sectional view taken along the line 4—4 of FIG. 2 illustrating a first operational mode of the apparatus of FIG. 2.
Figure 5:
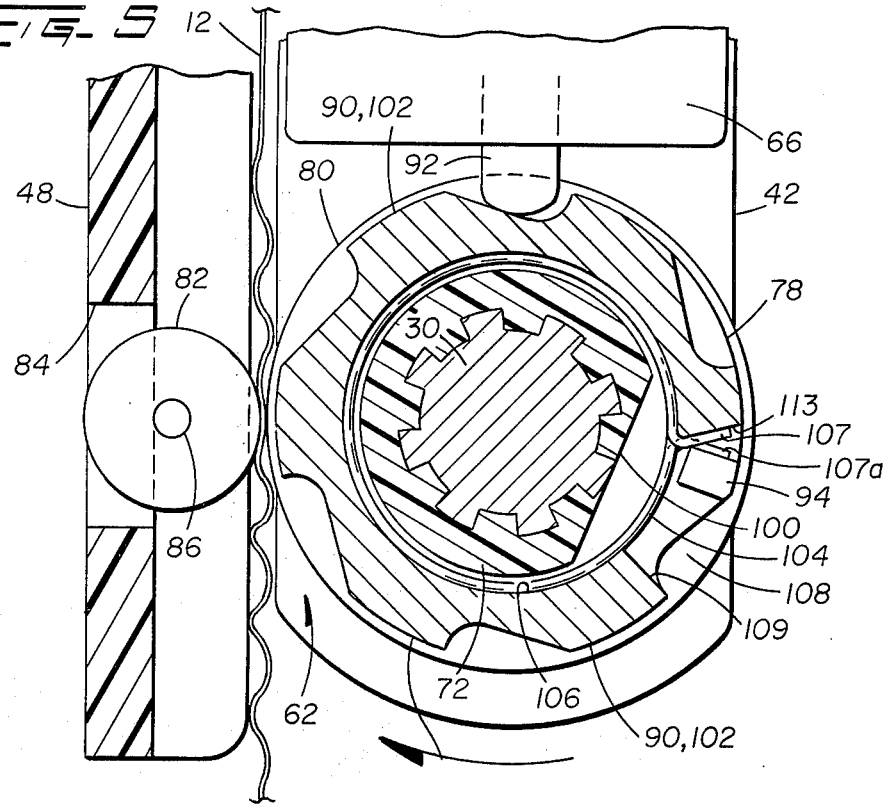
FIG. 5 is a partial sectional view taken substantially along the line 4—4 of FIG. 2 illustrating an alternate operational mode of the apparatus of FIG. 2.

The paper jam sensor also includes a drive shaft position cam 96 defining a keyed opening 98 shaped to mate with a flat 100 on the tractor drive gear extension 72 so that the drive shaft position cam 96 and the tractor drive gear 74 turn in unison in response to rotation of the drive shaft 30. As more clearly illustrated in FIG. 4, the drive shaft position cam 96 defines a circumferential camming surface 102 which displays a shape similar to the cam surface 90 defined by the paper advance cam 78. The two cam surfaces are adjacently positioned and rotate on a common axis. Therefore, the position of the switch plunger 92 is determined by both of the cams. That is, the switch plunger 92 will be depressed when either cam surface presents a rise to the plunger (FIG. 4) and the switch plunger will reach its extended position only when the cams are in registration and both of the cam surfaces present a fall to the plunger (FIG. 5). Serving the bias the cam surfaces out of registration, is a cam coil spring 104 coaxially positioned over the tractor drive gear extension 72 and nestled within a recess 106 defined by the drive shaft position cam 96. The coil spring 104 defines two outwardly extending ears 107 and **107*a*. Ear 107*a* engages the tab 94 extending from the paper advance cam 78 and the remaining ear engages the wall of a notch 108 defined by a facing surface of the drive shaft position cam 96. The spring tab 94 is positioned within the notch 108 and is forced against a wall 109 of the slot under bias of the coil spring 104, forcing the cam surfaces 90 and 102 out of registration as illustrated in FIG. 4. As mentioned, the coil spring 104 biases the cams out of registration so that the switch plunger 92 remains depressed throughout full rotation of the cams 78 and 96. The cams 78 and 96 are coaxially positioned on the tractor drive gear extension 72 and maintained thereon by means of a retaining clip 110 engaging the outer surface of the tractor gear extension 72**.

For purposes of discussion, it is assumed that the paper web 12 is positioned as illustrated in FIG. 1 so that the sprocket holes 20 and 22 along the marginal edges of the paper 12 engage their respective tractors. Closure of the tractor door 48 forces the pressure roller 82 against the paper, and the paper against the knurled surface 80 of the paper advance cam 78. In response to rotation of the drive shaft 30 in a clockwise direction as viewed in FIG. 4, the tractor gear 74 drives the belt 44 carrying the pull pins 46 thereby drawing the paper 12 across the print mechanism 14. Linear movement of the paper 12 imparts clockwise rotational movement to the paper advance cam 78 and the drive shaft position cam 96 correspondingly rotates clockwise. Thus, the angular rotational speed of the drive shaft corresponds to the angular speed of the paper advance cam. Under conditions of normal paper drive, the cams 78 and 96 are out of registration as illustrated in FIG. 4. It will be appreciated that throughout rotation of the cams, a rise on the surface of one of the cams is always presented to the switch plunger maintaining the switch in its normal actuated condition and providing a suitable indication to the control circuitry illustrated in FIG. 6 hereinafter additionally described.

The operation of the paper jam sensor 62, in response to a paper jam condition, is illustrated in FIG. 5. In the event that the paper 12 fails to smoothly feed past the print mechanism, the drive shaft 30 will, nevertheless, continue to rotate carrying with it the pull pin web 44 and the drive shaft position cam 96. However, under such conditions, linear paper movement will cease and correspondingly rotation of the paper advance cam 78 stops. The paper advance cam 78 remains substantially stationary as the coil spring 104 compresses until the tab 94 abuts a wall 113 of the notch 108 defined by the drive shaft cam 96. Once the tab is forced against the wall of the notch 108, the cams 78 and 96 rotate together in a clockwise direction with the drive shaft 30. The cams will rotate together in registration and upon alignment of the falls of both cams 78 and 96 with the switch plunger 92 (FIG. 5), the switch is actuated, generating a paper jam signal for the control circuit. To release the paper jam, the operator opens the tractor door 48. The paper advance cam 78 rotates clockwise under bias of the coil spring 104, forcing the cam surfaces 90 and 102 out of registration and the plunger moves upwardly to the normal operating position illustrated in FIG. 4. The jam condition is removed and the paper repositioned in the tractors 16 and 18.

Paper Depletion Sensor

Serving to sense the presence of paper in the printer is a single pole double throw paper depletion switch 114 mounted by means of a rectangular spacer 116 and suitable fasteners 118 to the switch mounting plate 68. The paper depletion switch 114 includes an actuating plunger 120 and pivotally carries thereon a paper sensing lever 122 which serves to actuate the switch plunger 120 when the paper 12 is properly positioned in the printer. As illustrstrated in FIG. 2, the switch lever 122 is forced by the paper 12 towards the body of the switch thereby depressing the plunger 120. In the event the paper supply is exhausted, the force on the lever is released and the plunger moves outwardly actuating the switch and thereby providing a signal to the control circuit.

Figure 6:
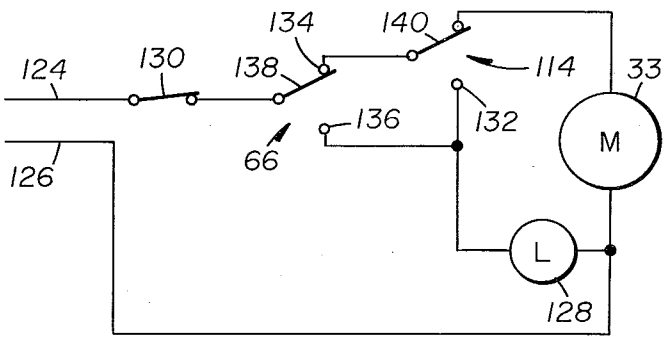
FIG. 6 is a schematic diagram illustrating certain of the control features of the apparatus of FIG. 1.

With reference to FIG. 6, that portion of the printer control circuit implementing the control signals initiated by the paper jam 66 and paper depletion 144 switches is illustrated. Each of the switches are shown in positions corresponding to the normal operative condition of the printer. Power from a conventional alternating current power source is provided via power input lines 124 and 126. Line 126 is directly connected to one terminal of the printer motor 33 and to one terminal of a paper malfunction indicator light 128. As illustrated, each of the switches 66 and 114 are single pole double throw and both of the switches 66 and 114 are series connected with an on-off power switch 130. The fixed contact of the power switch 130 is also connected to one movable contact 138 of the paper jam switch 66, a related fixed contact 136 of which is connected to one terminal of the malfunction indicator light 128 and to a fixed contact 132 of the switch 114. Additionally, a fixed contact 134 of the switch 66 is connected to a movable contact 140 of the switch 114 so that activation of either switch will provide a malfunction light 128 signal to the operator. Serving to interrupt the printer drive motor 33 in response to actuation of either of the switches 66 and 114 and thereby interrupt machine operation, poles 138 and 140 of the switches 66 and 114 respectively are series connected in series with the main power switch 130 to the motor 33. In this manner, actuation of either switch 66 or 114, with the power switch 130 closed, produces a dual response. That is, the printer motor 33 is interrupted and the malfunction indicator light 128 energized.

Operation

For purposes of discussion, it is assumed that the paper 12 is engaged by the tractor pull pins 46 and that the coil spring 104, during paper loading, has biased the cam surfaces 90 and 102 out of registration as illustrated in FIG. 4. As the drive shaft 30 rotates, the pull pins 46 draw the paper 12 across the print mechanism 14 and the drive shaft position cam 96, being keyed to the drive shaft 30, rotates with the pull pin movement. The paper roller 82 carried on the spring loaded tractor door 48 forces the paper 12 against the knurled surface 80 of the paper advance cam 78. As the paper 12 is pulled through the printer, the paper advance cam 78 and the drive position cam 96 rotate in unison with the rises of the drive shaft position cam 96 aligned with the falls defined by the paper advance cam 78. As the cams rotate, the paper jam switch plunger 92 rides on the rises of alternate cams holding the switch depressed with the motor 33 remaining energized and the circuit through the switch to the light 128 open. In repsonse to a paper jam, the free rotation of the paper advance cam 78 is obstructed while the drive shaft position cam 96 continues to rotate with the drive shaft 30. For a short period of time, the two cam surfaces rotate with respect to each other, tightening the coil spring until the stop tab carried by the paper advance cam abuts the wall of the drive shaft position cam, as illustrated in FIG. 5, with the cams 78 and 96 in registration. Therafter, the two cams rotate in unison under the torque of the drive shaft until the falls of both cam surfaces 90 and 102 are in registration with the plunger 92 and the paper jam switch moves to its alternate position. Upon actuation, the switch 66 disconnects the motor 33 from the power source and the malfunction light 128 is energized, providing the operator with a visual indication of the existence of a malfunction. To release the paper jam, the operator opens the tractor door 48 freeing the paper from frictional contact with the knurled surface 80 of the paper advance cam 78 and the cams 78 under bias of the coil spring rotate out of registration with the cam surfaces 90 and 102 returning to their normal offset relationship.

It is now assumed that the paper 12 is engaged by the tractor pull pins 46 and advanced properly through the printer. The presence of the paper forces the switch lever 122 of the paper depletion switch 114 toward the drive shaft 30 depressing the switch plunger 120 thus completing the circuit through the switch pole 140 to the motor 33. In the event the paper web 12 "runs out", the switch lever 122, under bias of the switch plunger 120, is forced away from the drive shaft 30 and the switch 114 interrupts power to the motor 33 and connects the malfunction light 128 to the power source. The printer is stopped and the operator provided with a visual indication of the existence of a paper malfunction. An apparatus has been described for sensing the operative condition of a printer carrying a continuous paper web and for providing the operator with an indication of such printer malfunctions.

Although the invention has been particularly shown and described with reference to a preferred embodiment thereof, it will be understood that various changes in form and detail may be made without departing from the scope and spirit of the invention.

What is claimed is:

1. An apparatus for sensing the operative condition of a web transported along a predetermined path by a drive mechanism engaging the web and thereby imparting a desired movement to the web comprising:

means for sensing the actual movement of the web; and means responsive to said drive mechanism and said web movement sensing means and serving to compare the actual movement of the web with the desired movement of the web as determined by the drive mechanism, said sensing means providing a signal related to the actual movement of the web as compared to the desired movement of the web said web movement responsive means includes a first cam and said web movement sensing means includes a second cam, said second cam displaying a shape similar to the shape defined by said first cam surface and means responsive to the relative positions of said cams and providing a signal in response to a predetermined relationship between said first and second cams.

2. The apparatus of claim 1 wherein said web movement sensing means includes means for engaging said web and said cam position responsive means includes a selectively actuable switch, the condition of said switch being responsive to the positional relationship of said first and second cams, said switch attaining a first position when said cams are in registration and a second position when said cams are out of registration.

3. The apparatus of claim 2 which further includes means for biasing said first and second cams out of registration.

4. The apparatus of claim 2 which further includes a control circuit responsive to the position of said switch and serving to control the operation of said drive mechanism and means for sensing the presence of said web, said web presence sensing means additionally providing a signal to said control circuit so as to interrupt operation of said drive mechanism in response to the absence of the web.

5. The apparatus of claim 4 wherein said control circuit includes means for providing the operator with an indication of the movement of said web; said indicating means being responsive to said first and second switches.

6. An apparatus for sensing the movement of a continuous paper web driven along a predetermined path by the drive mechanism of an automatic printer comprising:

means engaging the paper for imparting movement thereto along the predetermined path;

a first cam coupled to said drive means and providing an indication of the desired movement of the paper web;

a second cam coupled to said paper and providing an indication of the actual movement of said paper web; said first and second cams being adjacently positioned; and means responsive to said first and second cams for providing a signal in response to the relative positions of said cam so as to provide an indication of the actual movement as compared to the desired movement of the paper web.

7. The apparatus of claim 6 wherein said drive means includes a drive shaft and means coupled to said drive shaft for engaging the paper as to impart movement thereto along the predetermined path;

said first cam being rotatably positioned upon said drive shaft for movement with respect thereto and displaying a surface for frictionally engaging said paper, the linear movement of said paper imparting rotational movement to said first cam about said drive shaft; and said second cam being fixed to said drive shaft for movement therewith so as to provide an indication of the position of said drive shaft.

8. The apparatus of claim 7 wherein said first and second cams are similarly shaped and adjacently positioned; said means responsive to the relative position of said first and second cams including means positioned for engagement of said first and second cams and providing a first signal when said cams are in registration and a second signal when said cams are out of registration.

9. The apparatus of claim 8 which further includes means for biasing said cams into registration.

10. The apparatus of claim 9 wherein said cam positions sensing means includes a switch, the actuator of said switch is positioned to respond to the relative positions of said cams providing a signal related thereto and a printer control circuit receiving said switch signal.

11. The apparatus of claim 10 wherein said control circuit includes means for interrupting said paper drive means in response to a first positional relationship of said cams and enabling energization of said drive means in response to a second positional relationship of said cams.

12. The apparatus of claim 11 which further includes switch means responsive to the presence of paper in the printer, said switch means serving to interrupt the operation of said drive means in response to the absence of paper in the printer.

13. The apparatus of claim 9 wherein said second cam defines an arcuate notch and said first cam defines a stop tab positioned within said notch so as to limit relative movement between said first and second cams from a first position whereat said cams are in registration to a second position whereat said cams are out of registration, said biasing means urging said cams to said second position.

14. The apparatus of claim 13 wherein said control circuit includes means for interrupting said paper drive means when said cams are in said first position and enabling energization of said drive means when said cams are in said second position.

15. The apparatus of claim 14 which further includes switch means responsive to the presence of paper in the printer, said switch means serving to interrupt the operation of said drive means in response to the absense of paper in the printer.

16. A method for sensing a malfunction in the movement of a paper web through an automatic printer comprising the steps of:

positioning a first cam in relation to the desired movement of the paper;

positioning a second cam in relation to the actual movement of the paper;

sensing the relative positions of the first and second cams and providing a signal in response to a predetermined condition; and interrupting the paper drive mechanism in response to said predetermined condition.

17. The method of claim 16 which further comprises the steps of:

biasing said first and second cams out of said predetermined position.

* * * * *